United States Patent [19]

McCormick

[11] Patent Number: 4,897,057

[45] Date of Patent: Jan. 30, 1990

[54] MARINE PROPULSION UNIT UNIVERSAL DRIVE ASSEMBLY

[75] Inventor: Daniel F. McCormick, Oshkosh, Wis.

[73] Assignee: Brunswick Corporation, Skokie, Ill.

[21] Appl. No.: 228,320

[22] Filed: Aug. 4, 1988

[51] Int. Cl.[4] ..... B63H 21/32

[52] U.S. Cl. ..... 440/57; 440/88

[58] Field of Search ..... 440/57, 88, 89, 111, 440/112, 113, 53; 277/30, 212 FB

[56] References Cited

U.S. PATENT DOCUMENTS

| | | | |
|---|---|---|---|
| 3,136,285 | 6/1964 | Kiekhaefer | 440/63 |
| 3,893,407 | 7/1975 | Hurst | 440/57 |
| 3,933,116 | 1/1976 | Adams et al. | 440/57 |
| 4,201,391 | 5/1980 | Bankstahl | 440/112 |
| 4,753,619 | 6/1988 | Sullivan | 440/88 |

*Primary Examiner*—Sherman D. Basinger
*Assistant Examiner*—Stephen P. Avila
*Attorney, Agent, or Firm*—Robert C. Curfiss

[57] ABSTRACT

A marine propulsion device is provided wherein a flexible bellows (33) surrounding the universal joint (20) disposed between a marine engine (5) and a stern drive unit (2) is mounted to rotate with the universal joint itself. The universal joint is disposed within a chamber (61) delineated by the bellows itself and by end caps (34,43) mounted to the universal joint shafts (25,30). Supports (53,56) for the universal joint bearings (54) are constructed to permit free flow of fluid around the bearings. A quantity of lubricating oil is supplied to the chamber and at least partially fills the chamber when the latter is at rest. Upon driving rotation of the device, the bellows and universal joint and lubricating oil all rotate together. The resultant centrifugal force causes the oil to flow radially outwardly through the bearing supports to lubricate the bearings, with the oil forming a rotating mass engaging the inner bellows face. To support the bellows against the rotating mass, a helical spring (69) is mounted externally of the bellows and within the bellows convolutions, with the spring being anchored (73) adjacent both ends of the bellows. In addition, the bellows function as a finned heat radiator.

13 Claims, 3 Drawing Sheets

FIG. 1
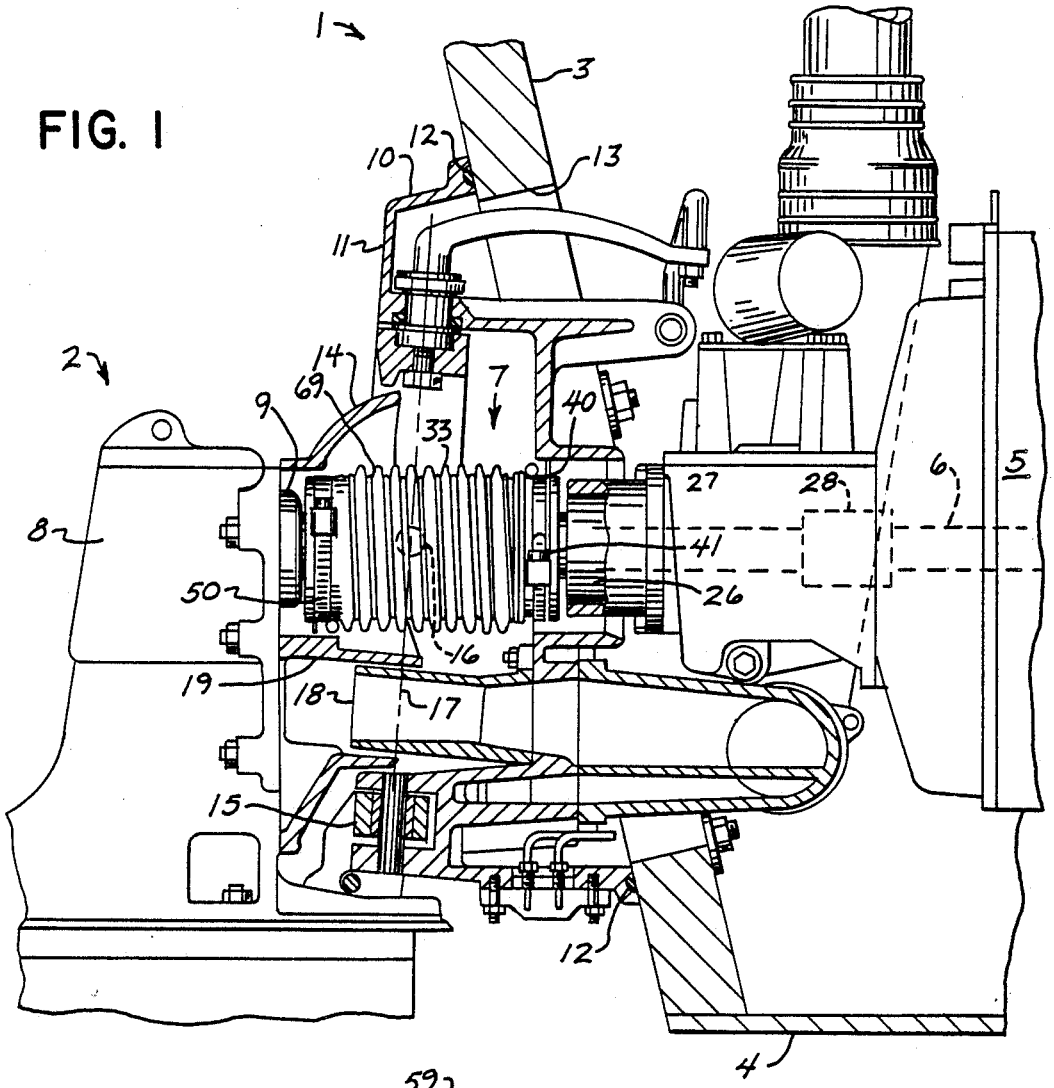
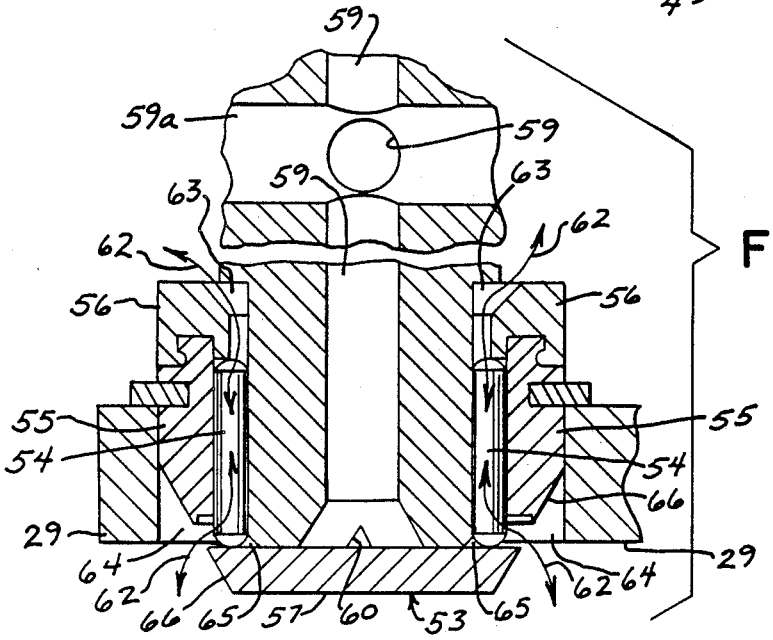
FIG. 5

MARINE PROPULSION UNIT UNIVERSAL DRIVE ASSEMBLY

BACKGROUND AND SUMMARY OF THE INVENTION

This invention relates to a marine propulsion unit universal drive assembly, and more particularly to an arrangement wherein a circumferential bellows encircles the universal drive coupling which permits all-direction pivoting of the stern drive unit.

It is known to provide a flexible bellows around the universal joint connecting a marine stern drive unit to an inboard engine. See, for example, U.S. Pat. Nos. 3,136,285 and 4,201,391. In the latter patent, the bellows is attached to a stationary tubular extension on the gimbal ring housing, thus necessitating sufficient clearance between the bellows and the universal joint rotating therewithin. Furthermore, in known devices of the '391 type, grease fittings have been required in the universal joint to provide lubrication to the joint bearings. This type of lubricating is not maintenance free, and the joint area usually has to be serviced on a regular basis. Furthermore, undesirable heat buildup has been observed in the joint of devices of the '391 type.

It is a task of the present invention to reduce the required diameter of the bellows without having to change the dimensions of the universal joint itself, thus making it possible to devise a more compact stern drive. It is a further task of the invention to eliminate the need for grease fittings and the like, and to provide for a more maintenance free joint arrangement while providing fully adequate lubrication therefor. It is yet another task to effectively reduce heat buildup in the area of the joint.

In accordance with the various aspects of the invention, a marine propulsion device is provided wherein the flexible bellows surrounding the universal joint disposed between a marine engine and a stern drive unit is mounted to rotate with the universal joint itself. The universal joint is disposed within a chamber delineated by the bellows itself and by end caps mounted to the universal joint shafts. Supports for the universal joint bearings are constructed to permit free flow of fluid around the bearings. A quantity of lubricating oil is supplied to the chamber and at least partially fills the chamber when the latter is at rest. Upon driving rotation of the device, the bellows and universal joint and lubricating oil all rotate together. The resultant centrifugal force causes the oil to flow radially outwardly through the bearing supports to lubricate the bearings, with the oil forming a rotating mass engaging the inner bellows face. To support the bellows against the rotating mass, a helical spring is mounted externally of the bellows and within the bellows convolutions, with the spring being anchored adjacent both ends of the bellows. In addition, the bellows functions as a finned heat radiator.

BRIEF DESCRIPTION OF THE DRAWINGS

The accompanying drawings illustrate the best mode presently contemplated by the inventor for carrying out the invention.

In the drawings:

FIG. 1 is a side elevation, with parts broken away and in section, of a marine stern drive unit incorporating the various aspects of the invention;

FIG. 5 is an enlarged generally sectional detail of the end of one of the cross arms of the universal joint.

DESCRIPTION OF THE PREFERRED EMBODIMENT

Figure 2:
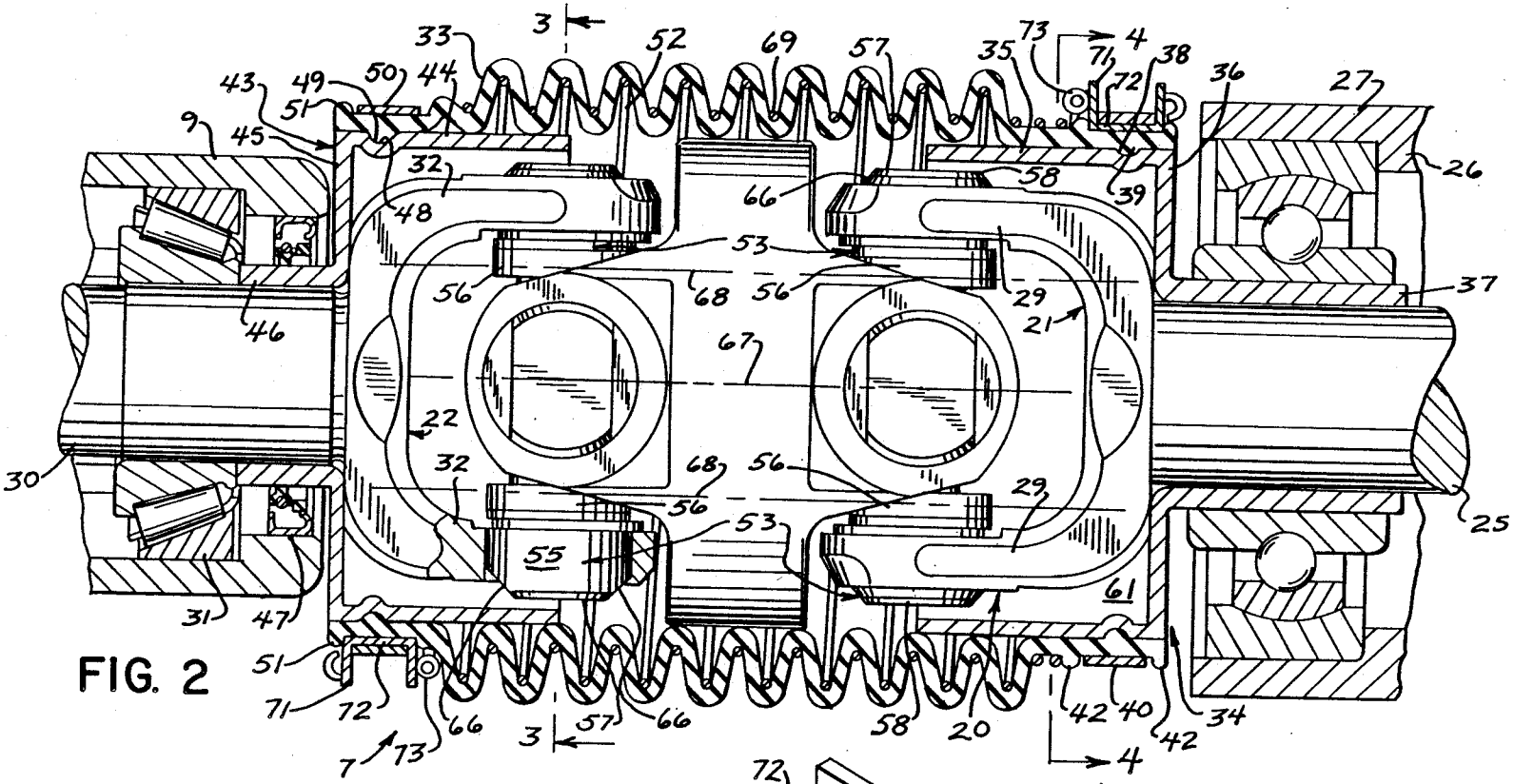
FIG. 2 is an enlarged side elevation, with parts broken away and in section, of the universal joint connection for the stern drive.

As shown in the drawings, the aspects of the invention are adapted to be incorporated in a marine propulsion unit 1 including a stern drive unit 2 mounted to the transom 3 of a boat 4. An inboard mounted engine 5 is disposed within boat 4 and is provided with a rearwardly extending output shaft 6. Shaft 6 is interconnected through a universal drive assembly 7 to stern drive unit 2. Drive unit 2 generally includes a housing 8 having a forwardly extending cylindrical projection 9.

A transom mount 10 secures stern drive unit 2 to transom 3. Mount 10 generally includes a mounting bracket 11 and a seal 12 for sealing the transom opening 13. Mount 10 also includes an opening through which the connecting drive extends. Drive unit housing 8 has bolted thereto a bell housing 14 which in turn is pivotally mounted to a gimbal ring 15. Gimbal ring 15 is in turn mounted to pivot about a horizontal pivot axis, as at 16, for trimming; and about generally vertical pivots 17 for steering. An exhaust tube 18 connects to engine 5 and projects rearwardly beneath universal drive assembly 7 and telescopes within a further exhaust tube 19.

Universal drive assembly 7 includes a universal joint 20 of usual construction, which constitutes, in part, a forward yoke 21 and a rearward yoke 22 which are joined to a rotatable intermediate member, commonly called a cross 23, with cross 23 having two pair of opposed cross arms 24. Forward yoke 21 includes a central yoke shaft 25 which extends forwardly through an annular bearing 26 mounted within a rearward engine projection 27. Yoke shaft 25 rotates about a central drive axis and is suitably coupled to engine output shaft 6, as at 28. The rearward end of yoke shaft 25 merges into a forked pair of yoke arms 29. Likewise, rearward yoke 22 includes a central yoke shaft 30, which is generally coaxial with yoke shaft 25. Shaft 30 extends rearwardly through an annular bearing 31 mounted within projection 9 of housing 8, with shaft 30 being suitably coupled in any well-known manner to the propeller drive. The forward end of yoke shaft 30 merges into a forked pair of yoke arms 32.

Rotation of forward yoke shaft 25 causes rotation of universal joint 20, and ultimately rotation of rearward yoke shaft 30 to drive the unit's propeller means.

In accordance with certain aspects of the invention, an annular protective flexible convoluted bellows 33 is disposed about universal joint 20 and is mounted so as to rotate with the latter. For this purpose, and as best seen in FIG. 2, a stamped metal end cap 34 is mounted to forward yoke shaft 25 and is generally Z-shaped in section, providing a cylindrical outer wall 35, a base 36 and a cylindrical central sleeve 37. Sleeve 37 is mounted within bearing 26 and is permanently press fit onto shaft 25 so that cap 34 rotates with the shaft. Cylindrical wall 35 is disposed radially outwardly a short distance from yoke 21 and is adapted to telescopingly receive the forward end portion of bellows 33 thereover. An annual groove 38 in the outer face of the inner end of wall 35 receives an annular inwardly extending enlargement 39 forming part of bellows 33; and an annular hose clamp 40 surrounds bellows 33 adjacent groove 38, and is held in place by a tightening screw 41. Annular beads 42 on bellows 33 hold clamp 40 therebetween. The elements provide tight clamping of the forward bellows end to end cap 34.

Likewise, a stamped metal end cap 43 is axially spaced from cap 34 and is mounted to rearward yoke shaft 30 and is generally Z-shaped in section, providing a cylindrical outer wall 44, a base 45 and a cylindrical central sleeve 46. Sleeve 46 is mounted within bearing 31 and is permanently press fit onto shaft 30 so that cap 43 rotates with the shaft. An annular oil seal 47 is disposed between a reduced I.D. forward end of projection 9 and sleeve 46. Cylindrical wall 44 is disposed radially outwardly a short distance from yoke 22 and is adapted to telescopingly receive the rearward end portion of bellows 33 thereover. An annular groove 48 in the outer face of the inner end of wall 44 receives an annular inwardly extending enlargement 49 forming part of bellows 33; and an annular hose clamp 50 surrounds bellows 33 adjacent groove 48, and is held in place in the usual manner. Clamp 50 is also held in place by bead means 51 on bellows 33. The rear bellows end is thus tightly clamped to end cap 43.

Because bellows 33 rotates with universal joint 20, the bellows and its mounting elements can be reduced in diameter to provide less clearance with joint 20 without danger of interference therebetween, as was the case when the universal joint rotated within a stationary bellows.

A helical spring 52 is mounted internally of the convolutions of bellows 33, in a conventional manner, to keep the bellows from flattening out under certain operating conditions.

Figure 3:
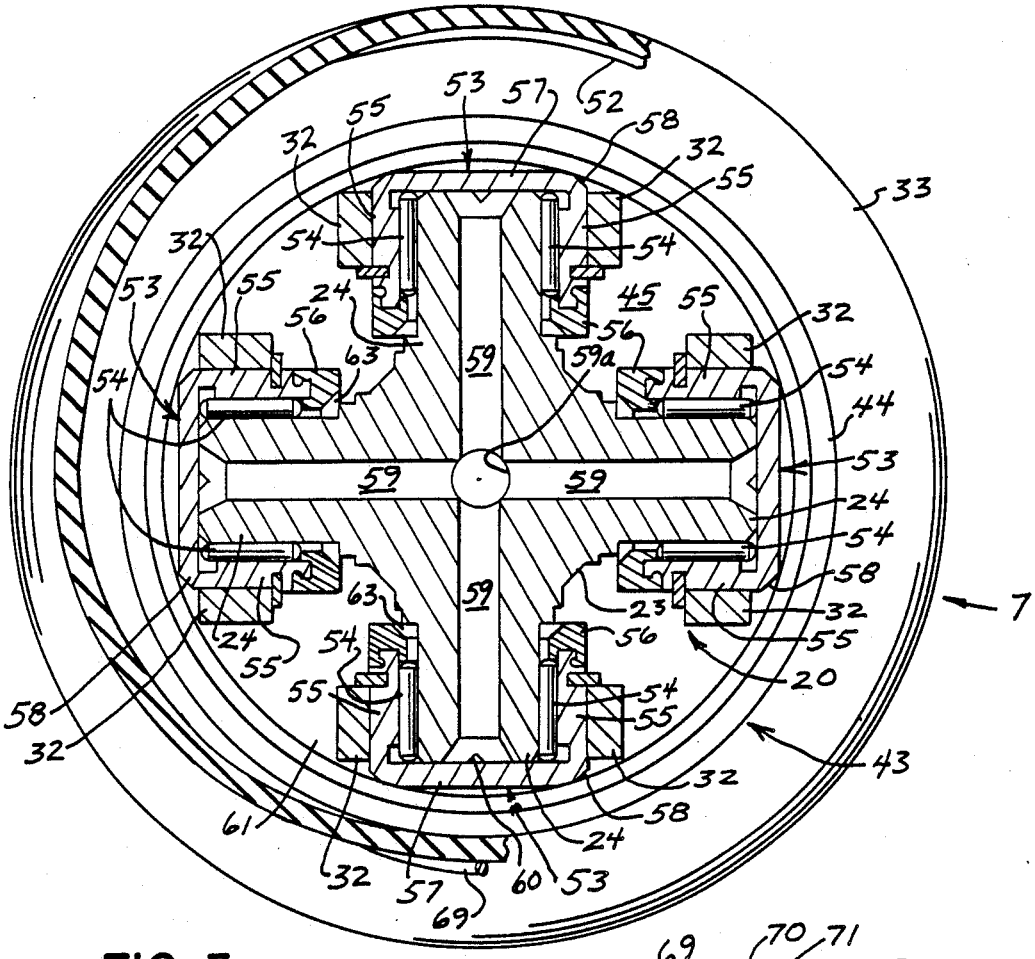
FIG. 3 is a transverse section taken on line 3—3 of FIG. 2.
Figure 4:
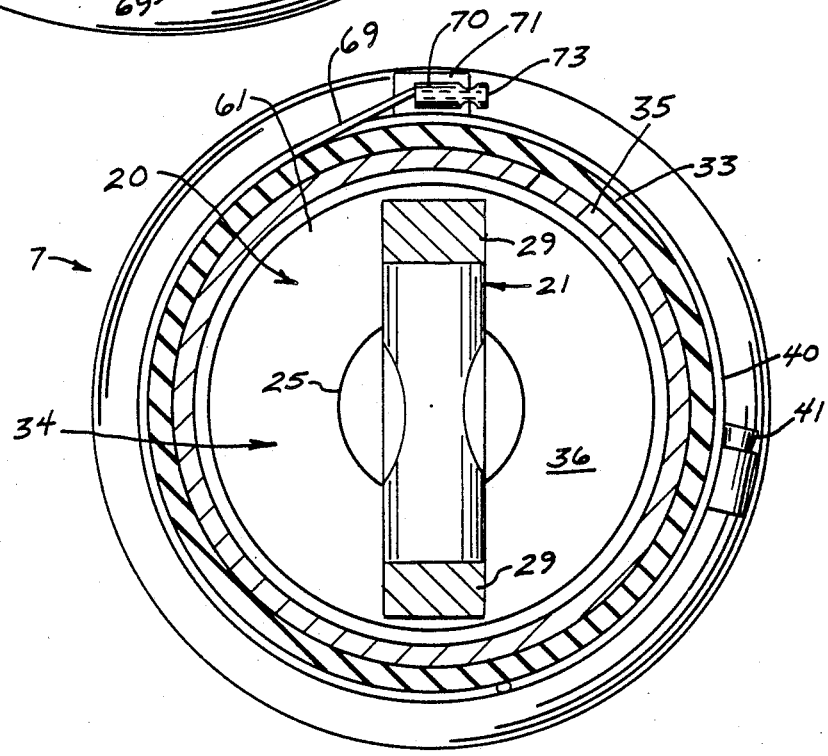
FIG. 4 is a transverse section taken on line 4—4 of FIG. 2.

As best seen in FIG. 3, the outer terminus end portion of each arm 24 of cross 23 serves to mount a yoke arm 29, 32 for relative rotation. For this purpose, a cup-shaped bushing 53 is mounted to the end of each arm, with roller bearings 54 confined between the bushing side walls 55 and the respective arm periphery. Side walls 55 are in turn confined beween bearings 54 and the respective yoke arm 29, 32. A retainer 56 on arm 24 holds bearings 54 in place. Bushing side walls 55 merge into a generally planar base 57 having a bevelled edge 58. Cross 23 is also provided with centrally intersecting radially extending passages 59 in each arm 24 which intersect at a lubricant supply port 59*a*, with the outer passage ends terminating in a notch 60 at base 57. Passages 59 serve to contain lubricant.

It is necessary to provide suitable lubrication to universal joint 20. However, the previous arrangements utilizing grease fittings and requiring regular maintenance have not been entirely satisfactory. In accordance with additional aspects of the invention, means are provided to eliminate the need for grease fittings, and to cause a flow of lubricant through bearings 54 upon rotation of universal joint 20.

For this purpose, it is contemplated that the internal chamber 61 delineated by bellows 33 and end caps 34 and 43, be provided on a generally permanent basis with lubricating fluid. At the same time, bearings 54 are opened up to fluid flow therealong. This is accomplished by providing a circulating fluid flow path shown by the arrows 62 which extends in a generally radial direction within assembly 7 and along the bearing rollers. See especially FIG. 5. Flow path 62 is formed by a suitable passage 63 adjacent retainer 56 as well as an outlet passage 64 formed in bushing base 57 adjacent bevelled edge 58, and with passages 63 and 64 communicating between the bearing chamber 65 and internal bellows chamber 61. In the present embodiment, outlet passage 64 is formed by diagonally grinding away and thus modifying the corners of bushing base 57 and side walls 55, as at 66. Other placements for passage 64 may be utilized without departing from the spirit of the invention.

A quantity of lubricating oil is added to chamber 61 and may be brought to a desired top level when universal drive assembly 7 is at rest. A suitable level might be from $\frac{1}{3}$ to $\frac{1}{2}$ full, the latter condition being shown at 67. When assembly 7 is rotated during stern drive operation, bellows 33 and universal joint 20 and the lubricating oil will all rotate together. The resultant centrifugal force will cause the oil to flow generally freely and radially outwardly and form a generally cylindrical rotating mass of oil around the outer portion of chamber 61. The inner peripheral wall of the oil mass during rotation will be concentrically disposed about the axis of rotation of joint 20 and is shown at 68.

The generally radial flow of oil in chamber 31 will be such that the oil will circulate along flow path 62, thus providing essentially continuous lubrication through bearings 54. Oil will also flow radially outwardly through cross passages 59 and past notches 60 to provide lubrication at the inner faces of bushing base 57. As rotation of assembly 7 decreases, there will also be a flow in the opposite direction, with accompanying lubricating flow past bearings 54.

The arrangement is such that a thinner lubricant, such as weight EP-90, can be used, as compared to the previously used heavier greases. Furthermore, by the co-rotation of the assembly elements, there is little or no energy loss and little hydraulic turbulence. The result is increased cooling, efficiency, and torque capacity.

Figure 6:
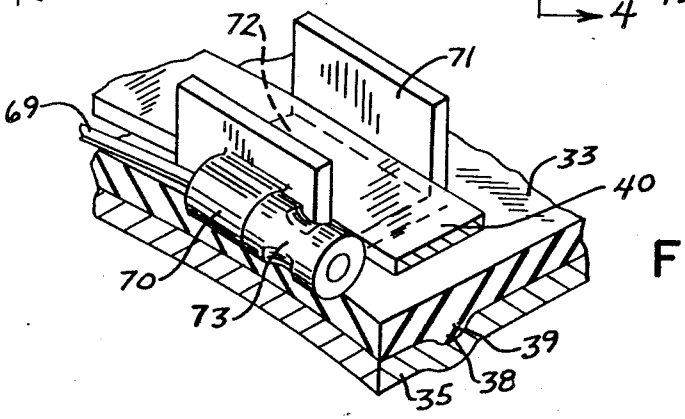
FIG. 6 is an enlarged isometric showing of a spring anchoring means.

The mass of rotating oil under the influence of centrifugal force tends to put a radially outwardly directed load on the inner surface of bellows 33. In accordance with other aspects of the invention, means are provided to support bellows 33 against this load. For this purpose, and in the present embodiment, a helical wire spring 69 is wound around the outside of bellows 33 and disposed in the valleys of the convolutions thereof. Spring 69 is retained and anchored at both ends in clips 70 attached to short channel members 71 having base portions 72 confined between hose clamps 40 and bellows 33. See FIG. 6. Ferrules 73 secure the spring ends to clips 70. Spring 69 serves to restrain bellows 33 against enlargement due to the relatively extensive centrifugal force caused by the combination of the rotating bellows and mass of oil.

The construction and operation of universal drive assembly 7 is such that the oil serves as a coolant and bellows 33 functions as a rotating finned radiator which transfers heat buildup of the moving parts to the outside. This heat dissipating function provides a cooler running universal joint.

Various modes of carrying out the invention are contemplated as being within the scope of the following claims which particularly set forth and distinctly claim the subject matter regarded as the invention.

I claim:

1. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint and forming a lubricant-containing bellows chamber (61), (d) mounting means for fixedly securing said bellows to said support means so that said bellows rotates with said universal joint, (e) bearing means (54) mounted to said universal joint within said chamber, (f) means open to said chamber and defining a circulatory fluid flow path (62) through said bearing means, (g) the construction being such that rotation of said universal joint and said bellows causes lubricant in said chamber to circulate generally radially along said path and through said bearing means to lubricate the latter, and with centrifugal force causing the said lubricant to form a cylindrical mass at the inner surface of said bellows, (h) and restraining means (69) for supporting said bellows against enlargement under the centrifugal force load of said cylindrical mass of lubricant, (i) said bellows and said lubricant forming co-rotating means to dissipate heat from said chamber.

2. The marine universal drive assembly of claim 1 in which:

(a) said universal joint (20) includes forwardly and rearwardly disposed yokes (21,22) having rotatable yoke shafts (25,30) merging into yoke arms (29,32), (b) and said support means comprises front and rear members (34,43) mounted for rotation on said respective yoke shafts, and with said members having generally cylindrical outer walls (35,44) to which the ends of said bellows (33) are secured by said mounting means.

3. The marine universal drive assembly of claim 1:

(a) in which said universal joint (20) includes forwardly and rearwardly disposed yokes (21,22) having respective yoke arms (29,32), (b) an intermediate member (23) interconnected between said yokes, (c) bushing means (53) disposed on said intermediate member and receiving said yoke arms, (d) said bearing means (54) being confined in a bearing chamber (65) disposed between said bushing means and said intermediate member, (e) and said flow path defining means includes an opening (64) in said bushing means which communicates between said bearing chamber (65) and said bellows chamber (61).

4. The marine universal drive assembly of claim 1:

(a) in which said restraining means comprises a helical spring (69) wound around the outside of said bellows (33) and disposed in the valleys of the bellows convolution, (b) and means (70,71,73) for anchoring the ends of said spring adjacent the ends of said bellows.

5. The marine universal drive assembly of claim 1 in which said bellows (33) forms a finned heat radiator.

6. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint and forming a lubricant-containing bellows chamber (61), (d) and mounting means for fixedly securing said bellows to said support means so that said bellows rotates with said universal joint.

7. The marine universal drive assembly of claim 6 in which:

(a) said universal joint (20) includes forwardly and rearwardly disposed yokes (21,22) having rotatable yoke shafts (25,30) merging into yoke arms (29,32), (b) and said support means comprises front and rear members (34,43) mounted for rotation on said respective yoke shafts, and with said members having generally cylindrical outer walls (35,44) to which the ends of said bellows (33) are secured by said mounting means.

8. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint and forming a lubricant-containing bellows chamber (61), (d) mounting means for fixedly securing said bellows to said support means so that said bellows rotates with said universal joint, (e) bearing means (54) mounted to said universal joint within said chamber, (f) and means open to said chamber and defining a circulatory fluid flow path (62) through said bearing means.

(g) the construction being such that rotation of said universal joint and said bellows causes lubricant in said chamber to circulate generally radially along said path and through said bearing means to lubricate the latter, and with centrifugal force causing the said lubricant to form a cylindrical mass at the inner surface of said bellows.

9. The marine universal drive assembly of claim 8:

(a) in which said universal joint (20) includes forwardly and rearwardly disposed yokes (21,22) having respective yoke arms (29,32), (b) an intermediate member (23) interconnected between said yokes, (c) bushing means (53) disposed on said intermediate member and receiving said yoke arms, (d) said bearing means (54) being confined in a bearing chamber (65) disposed beween said bushing means and said intermediate member, (e) and said flow path defining means includes an opening (64) in said bushing means which communicates between said bearing chamber (65) and said bellows chamber (61).

10. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint and forming a lubricant-containing bellows chamber (61), (d) mounting means for fixedly securing said bellows to said support means so that said bellows rotates with said universal joint, (e) bearing means (54) mounted to said universal joint within said chamber, (f) means open to said chamber and defining a circulatory fluid flow path (62) through said bearing means, (g) the construction being such that rotation of said universal joint and said bellows causes lubricant in said chamber to circulate generally radially along said path and through said bearing means to lubricate the latter, and with centrifugal force causing the said lubricant to form a cylindrical mass at the inner surface of said bellows, (h) and restraining means (69) for supporting said bellows against enlargement under the centrifugal force load of said cylindrical mass of lubricant.

11. The marine universal drive assembly of claim 10:

(a) in which said restraining means comprises a helical spring (69) wound around the outside of said bellows (33) and disposed in the valleys of the bellows convolutions, (b) and means (70,71,73) for anchoring the ends of said spring adjacent the ends of said bellows.

12. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint, (d) mounting means for fixedly securing said bellows to said support means so that said bellows rotates with said universal joint, (e) and a helical spring (69) wound around the outside of said bellows and disposed in the valleys of the bellows convolutions, (f) the ends of said spring being anchored adjacent the ends of said bellows, (g) said spring forming restraining means supporting said bellows when rotating against enlargement under centrifugal force loads.

13. A universal drive assembly (7) for connecting the rotary output (6) of an inboard marine engine (5) to a rearwardly disposed outboard mounted stern drive unit (2), comprising, in combination:

(a) a universal joint (20) rotatable about a drive axis and adapted for respective connection to the engine and stern drive unit, (b) axially spaced support means (35,44) mounted for rotation with said universal joint, (c) a cylindrical bellows (33) surrounding said universal joint and forming a lubricant-containing bellows chamber, (d) mounting means for fixedly securing said bellows to said support means so that said bellows rotates with said universal joint, (e) said bellows and said lubricant forming co-rotating means to dissipate heat from said chamber, (f) said bellows forming a finned heat radiator.

* * * * *